US010242535B2

(12) United States Patent
Fishon

(10) Patent No.: US 10,242,535 B2
(45) Date of Patent: Mar. 26, 2019

(54) GAME TOURNAMENTS AND GAMING SYSTEMS HAVING A LOSS ACCUMULATION FEATURE

(71) Applicant: Todd Fishon, Henderson, NV (US)

(72) Inventor: Todd Fishon, Henderson, NV (US)

( * ) Notice: Subject to any disclaimer, the term of this patent is extended or adjusted under 35 U.S.C. 154(b) by 0 days.

(21) Appl. No.: 15/701,267

(22) Filed: Sep. 11, 2017

(65) Prior Publication Data

US 2018/0075703 A1 Mar. 15, 2018

Related U.S. Application Data

(60) Provisional application No. 62/394,090, filed on Sep. 13, 2016.

(51) Int. Cl.
*A63F 9/00* (2006.01)
*G07F 17/32* (2006.01)

(52) U.S. Cl.
CPC ..... *G07F 17/3276* (2013.01); *G07F 17/3209* (2013.01); *G07F 17/3211* (2013.01); *G07F 17/3225* (2013.01); *G07F 17/3244* (2013.01); *G07F 17/3246* (2013.01); *G07F 17/3293* (2013.01)

(58) Field of Classification Search
None
See application file for complete search history.

(56) References Cited

U.S. PATENT DOCUMENTS

| | | | | |
|---|---|---|---|---|
| 5,779,242 | A | 7/1998 | Kaufmann | |
| 7,076,434 | B1 | 7/2006 | Newnam et al. | |
| 7,740,243 | B1 * | 6/2010 | Kean | G07F 17/329 273/139 |
| 8,460,090 | B1 * | 6/2013 | Gilliland | G07F 17/3262 463/16 |
| 8,758,106 | B2 | 6/2014 | Wolf et al. | |
| 9,177,445 | B2 | 11/2015 | Vemuri et al. | |
| 2005/0173862 | A1 * | 8/2005 | Orenstein | A63F 1/18 273/292 |
| 2006/0178185 | A1 * | 8/2006 | Weis | A63F 1/18 463/13 |
| 2008/0315521 | A1 * | 12/2008 | Reabe, Jr. | A63F 1/00 273/292 |
| 2009/0011827 | A1 * | 1/2009 | Englman | G07F 17/34 463/27 |
| 2016/0321874 | A1 * | 11/2016 | Chase | G07F 17/3276 |

* cited by examiner

*Primary Examiner* — Seng Heng Lim
(74) *Attorney, Agent, or Firm* — Weide & Miller, Ltd.

(57) ABSTRACT

A gaming tournament and tournament system allow multiple players to play a plurality of individual games, such as at gaming machines of the system. Each player plays individual games until they have achieved a predesignated number of game losses. Each player is assigned a tournament score, such as comprising an aggregate of points which are awarded for each winning game outcome. The individual games may comprise poker games which include a replacement card feature and a dynamic point award configuration.

19 Claims, 6 Drawing Sheets

GAME TOURNAMENTS AND GAMING SYSTEMS HAVING A LOSS ACCUMULATION FEATURE

RELATED APPLICATION DATA

This application claims priority to U.S. Provisional Application Ser. No. 62/394,090, filed Sep. 13, 2016, the contents of which are incorporated in its entirety herein.

FIELD OF THE INVENTION

The present invention relates to gaming tournaments and gaming machines and systems configured to present such tournaments.

BACKGROUND OF THE INVENTION

Existing wager-based gaming tournaments have a number of drawbacks. One type of tournament is a slot tournament. Generally, in this type of a tournament a player pays an entry fee and then plays as many slot games as possible during a set period of time. One drawback to this type of tournament is that no skill is involved, making the play of each underlying slot game uninteresting.

Other types of tournaments include games of skill, but have other drawbacks. For example, a poker tournament may be played until all players except the winning player have lost their chips. In order to achieve this outcome, however, the tournament may last day or weeks. It may not be feasible for the players to participate for such a long period of time or for a casino to frequently dedicate the resources necessary to present such a tournament. Also, in these tournaments, if a player gets off to a bad start by losing most of their chips, it is nearly impossible for the player to ever catch up and win.

In order to cap the tournament duration, some tournaments simply allow a player to participate in a set number of games. For example, a player might play a set number of poker or blackjack games. However, these tournaments also have the problem that if a player starts poorly, they can't catch back up and win the tournament.

An improved gaming tournament is desired.

SUMMARY OF THE INVENTION

Embodiments of the invention comprise methods of playing and presenting games, as well as gaming devices and gaming systems. One embodiment of the invention comprises game play in the form of a multi-player gaming tournament, wherein each player's participation in the gaming tournament comprises the play of multiple individual games each having a game outcome. In one embodiment, each player plays games until they achieve a designated number of losing game outcomes. The outcome of the tournament may be determined with reference to a total score for each player where the score comprises an aggregate of points, such as assigned for winning game outcomes.

One embodiment of the invention is a tournament gaming system comprising a plurality of gaming machines and at least one tournament or game server. Each gaming machine may comprise a specially configured device having a monetary funds accepting mechanism for accepting monetary funds in creating a player credit balance, at least one display device, at least one player input device, a memory device, a controller, and machine-readable code stored in the memory device executable by said controller to, in response to a tournament fee placed by the player from the player credit balance, present games associated with a gaming tournament comprising: (a) causing the at least one display device to display game information regarding a game; (b) determining an outcome of the game as winning or losing; (c) awarding points to the player for a winning outcome of the game; and (d) repeating steps (a)-(c) until such time as a player has received a designated number of losing game outcomes.

The at least one tournament game server may comprise, said at least one game server comprising a processor configured to execute machine readable code, at least one communication interface which permits the game server to transmit information to the plurality of gaming machines and to receive information from the plurality of gaming machines, and machine readable code executable by the processor configured to cause the tournament server to determine an outcome of the gaming tournament based upon a total score of each player comprising a sum of points awarded to each player for winning game outcomes.

The designated or threshold number of losing game outcomes may depend upon the tournament and may comprise, for example, five (5) losing games.

In a preferred embodiment, each game comprises a skill-based game or a game having a skill component, whereby the outcomes of the games are at least partially influenced by decisions or actions of the player. In one embodiment, the games are poker games and each player plays a number of poker games until they receive the designated number of losing outcomes. In this configuration, certain poker hands are designated as winning hands and the remaining hands are losing, such as based upon a designated paytable.

Aspects of the invention comprise methods of awarding points for tournament game play. In one embodiment, points are only awarded to a player for winning game outcomes. In one embodiment, the number of points awarded to a player for a particular game outcome may increase, such as based upon a multiplier, from game to game. In embodiment, the points for winning game outcomes are increased during each consecutive game win and reset back to a base level when a losing outcome is achieved.

In one embodiment where the tournament comprises the play of poker games, a player may be provided with a sequence of potential replacement cards and a player may receive a higher number of points for achieving a designated winning combination of cards when lesser numbers of replacement cards are shown or used.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games, as well as gaming devices and gaming systems. One embodiment of the invention comprises game play in the form of a multi-player gaming tournament, wherein each player's participation in the gaming tournament comprises the play of multiple individual games each having a game outcome.

In a preferred embodiment, the methods of game play and presentation are implemented via a gaming device or gaming system. Such a gaming device might comprise a gaming machine or gaming table which may have various configurations.

A gaming machine may be located at a casino (and as such may be referred to as a "casino gaming machine"). As described below, such a gaming machine may be part of a gaming system, such as a casino gaming system which links two or more of the gaming machines or one or more gaming machines with other devices, such as one or more gaming tables, kiosks, accounting systems or servers, progressive systems or servers, player tracking systems or servers or the like.

Figure 1:
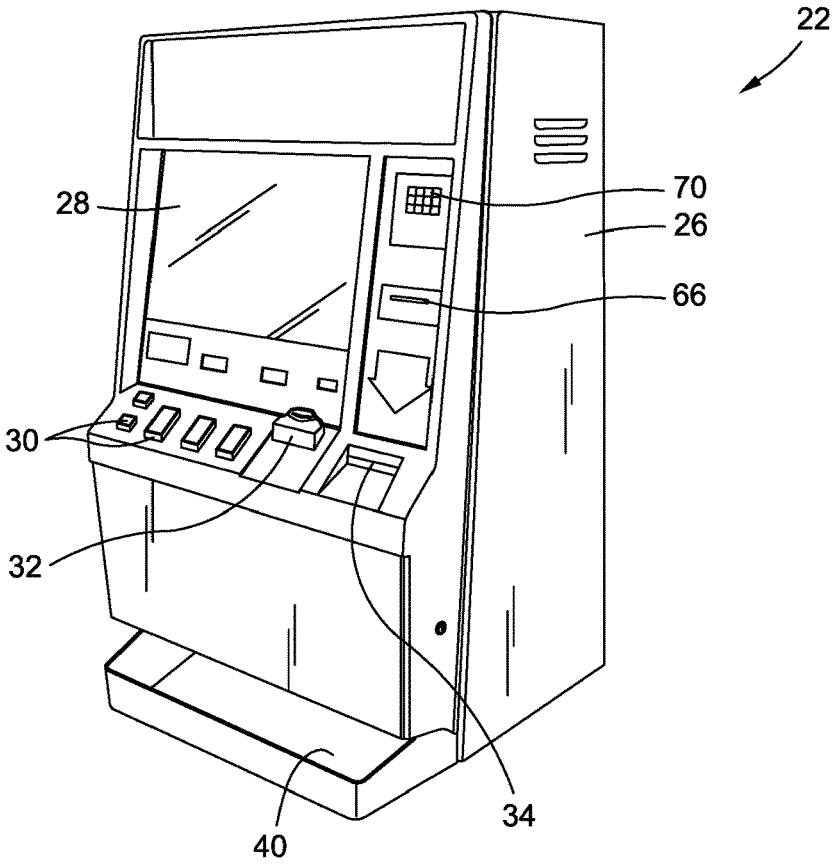
FIG. 1 illustrates a gaming machine in accordance with one embodiment of the invention.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes.

While the display devices may comprise one or more video displays, (such as for presenting video poker, video slots or other video-based games) in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes a mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be bought or sold, to "cash out" of the gaming machine, or to provide various other inputs.

In one preferred embodiment, the gaming machine 22 includes at least one microprocessor or controller for controlling the gaming machine, including receiving player input and sending output signals for controlling the various components or peripheral devices of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 (such as information comprising dealt cards, as detailed below), for determining winning or losing game outcomes and for displaying information regarding awards for winning game outcomes, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information). The gaming machine 22 may also include one or more random number generators for generating random numbers (such as implemented by a random number generator software module stored in the memory and executable by the processor or controller), such as for use in selecting cards or other game symbols and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions (e.g. software) which are configured to implement the game. In this regard, the gaming machine is specially configured to present the game of the invention via specific software and/or hardware which causes the gaming machine to operate uniquely. For example, the controller of the gaming machine 22 may be configured to detect a wager, such as a signal from a player's depressing of the "bet one" button (such as one of the buttons 30). Upon such an event and/or the player otherwise signaling the gaming machine to present the game, the controller may be configured to cause the at least one display 28 to display unique information, such as a unique graphical interface or unique game display, including game symbols or other game information (such as graphically represented images of cards, slot symbols, dice, etc.). The controller may accept input from a player of game inputs, such as a request to spin reels or the like, via the one or more player input devices of the gaming machine 22. As indicated above, the machine readable code may be configured in various manners, such as by having various "modules" of software which are designed to implement specific features of the game play or game presentation.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). For example, the gaming machine 22 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button (such as implemented via one of the buttons 30) or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray 40. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

The gaming machine 22 may, as noted above, be part of a system which includes other devices. For example, the gaming machine 22 may communicate with one or more casino systems, such as a player tracking server or system, an accounting system or server, a ticketing system, a bonusing system, other gaming machines, and external devices. As noted below, features of the invention may also be implemented relative to gaming devices which comprise gaming tables.

Figure 2:
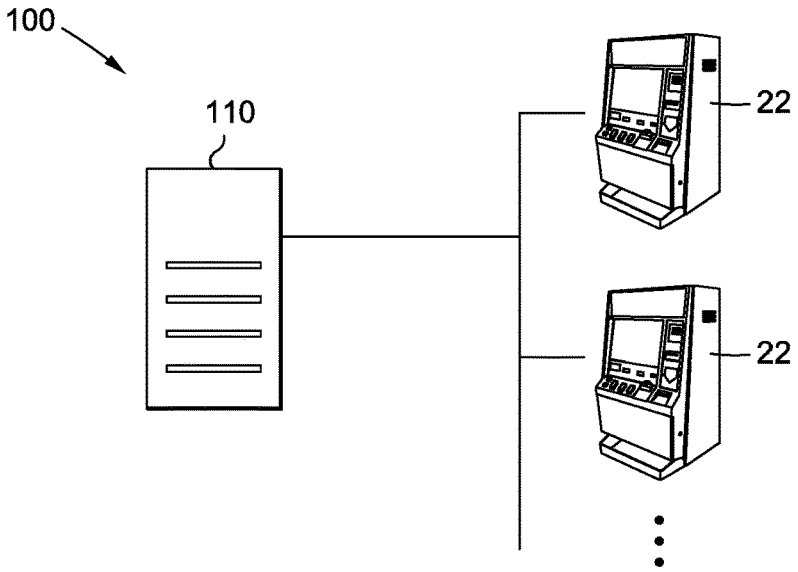
FIG. 2 illustrates a game system in accordance with one embodiment of the invention.

In embodiment, as illustrated in FIG. 2, a gaming system 100 comprises at least one server 110 and a plurality of gaming machines 22. The server 110 may comprise, for example, at least one controller, a memory for storing machine-readable code or software for use in implementing features of the invention, a database for storing data such as tournament data, and one or more communication interfaces, such as for allowing information to be exchanged with the gaming machines 22 and one or more user interface devices (such as a user interface station, not shown).

In one embodiment, the server 110 is at least configured to implement a tournament in accordance with the invention, and may thus be referred to as a tournament server. However, as noted above, in other embodiments, such a server might also be configured to implement underlying games or other features.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, instead of comprising a specially configured "casino"-style gaming machine, the game of the invention to be presented on other types of gaming devices, such as a computing or communication device, including at a home or office computer or a player's mobile electronic device such as a PDA, phone or the like. In one embodiment, a player might log in to a casino server (which may, for example, be configured as a web server) and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays. Such a "web" based version of the invention has the advantage that it allows the tournament to be offered to a greater number of players, such as players who are at home or the like. For example, as noted below, the tournament might be offered as a promotion and players might participate in the tournament via their home computer or their mobile communication device.

In the context of wagering tournament play via players of mobile communication devices or the like, player eligibility for play may be tracked or confirmed. For example, for-wager participation in the tournament may only be enabled for players who are located within a geographic location or area where gambling is legal. In such event, a player may be required to register their device with the operator and have their location tracked (such as via well-known geo-location techniques) to ensure that the player is within the geographic area where gambling is permitted. In this regard, player may also be required to register with the operator and provide age verification to ensure that they are of the required age to participate in the event (and may be required to confirm their identity when participating in the event).

One embodiment of a method of the invention will be described with reference to FIG. 3. In one embodiment of the invention, a player is required to place or pay an entry fee or wager to participate in the tournament. Thus, in a first step S1, a player places a wager. The amount of the wager may vary, and in one embodiment may be no less than a pre-set minimum amount such as $0.10, $0.25 or even $1 or $5. The wager might be placed as moneys, points, credits having monetary value or the like. As noted above, in one embodiment the wager may be placed from game credits, such as generated from monetary value which the player associated with a gaming machine. The tournament fee might be paid, for example, by the player using an input button of a gaming machine as described above. In one embodiment of the invention, different tournaments might be offered. The tournaments might have different features such as different start times, potential prizes as well as entry fees (e.g. the entry fees for the tournaments may vary).

It will be appreciated that how the tournament fee or wager is placed may vary. For example, in a gaming table environment, the player might pay with monetary value chips. In other embodiments, as described herein, a tournament might be offered as a promotion which does not require the player to pay an entry fee at all (in which case step S1 is not required).

In a step S2, once the player places any required fee (or otherwise enters the tournament), they are eligible to participate in a plurality of games. In one embodiment, the games may be presented as wagering games where the player is required to place a further wager or fee to play each game. In other embodiments, the entry fee entitles the player to play the games without a further wager or fee.

The tournament may be implemented relative to a variety of underlying games now known or later developed. For example, as described below, the tournament might involve the play of a plurality of video poker type games. However, the tournament might involve the play of slot games, blackjack games, baccarat games or a myriad of other games. In one embodiment, each game is presented to the player via the gaming device that they are playing. However, as noted below, the games might be presented at a gaming table or the like. The particular game information which is presented, user inputs, game rules and the like may vary depending upon the particular game which is presented.

Preferably, each game has an outcome. One or more (but not all) of the possible outcomes are preferably designated as winning. The remaining outcomes may be designated as losing. In step S3, the outcome of the game is determined. If in step S4, the outcome is winning, points or a score are preferably assigned to the player and the process repeats back to step S2 with the player playing another game. As noted below, the points which are awarded to a player for a winning game outcome may be determined in a number of ways, including based upon events which occur during the course of the game, based in part upon previous game outcomes and other factors. For example, as described in more detail below, dynamic point configurations may be provided where the points for particular game outcomes may increase or vary, such as depending upon the number of previous consecutive winning games.

If, however, the outcome of the game is losing in step S3, then in step S5, it is determined whether the player has reached a threshold or maximum number of losing game results. This threshold may vary and might comprise, for example, three (3) losing game or five (5) losing games (or other numbers of losing games, preferably comprising more than two (2) games). In one embodiment, different tournaments might have different losing game threshold values. For example, a player might pay an entry fee of $5 to play a tournament with a losing game threshold of five (5) games, and pay $10 to play a tournament with a losing game threshold of eight (8) games.

If player has not reached the threshold number of losing game outcomes, then the process repeats back to step S2 with the player playing another game. If the threshold has been reached, then in step S6, game play ends and a final score is determined for the player. This final or total score may comprise, for example, a sum of the number of points awarded to the player for each winning game outcome in step S4.

In a step S7, the outcome of the tournament is determined. In one embodiment, the one or more players with the highest total score for the tournament are declared winners. The one or more winners may be awarded one or more awards, such as a points, monies, free or reduced price goods or services, monetary value (such as monetary value credits which may be redeemed or cash-out by the player), etc.

In one embodiment, in order to facilitate completion of tournament play by each player, a player may be given a certain time duration to complete each game and/or to take actions within a game. This prevents, for example, a player from starting game play and then failing to complete the play of games until the number of game losses has been reached. As one example, a player might start the tournament and when the first game is presented, the player might be presented with a time period to complete the play of that game (such as 2 minutes). As soon as that game is completed, assuming that the player has not reached the threshold number of losses, the next game would be started and the timer would reset for that next game.

In one embodiment, game play for one or more players might end after a certain number of games or hands, regardless of the number of game losses. For example, assuming that all other players have completed their game play, the tournament might end as to a single remaining player once the player has achieved the highest score, even if the player has not reached the threshold number of losses (since additional game play by that player would not affect the outcome of the tournament).

Figure 3:
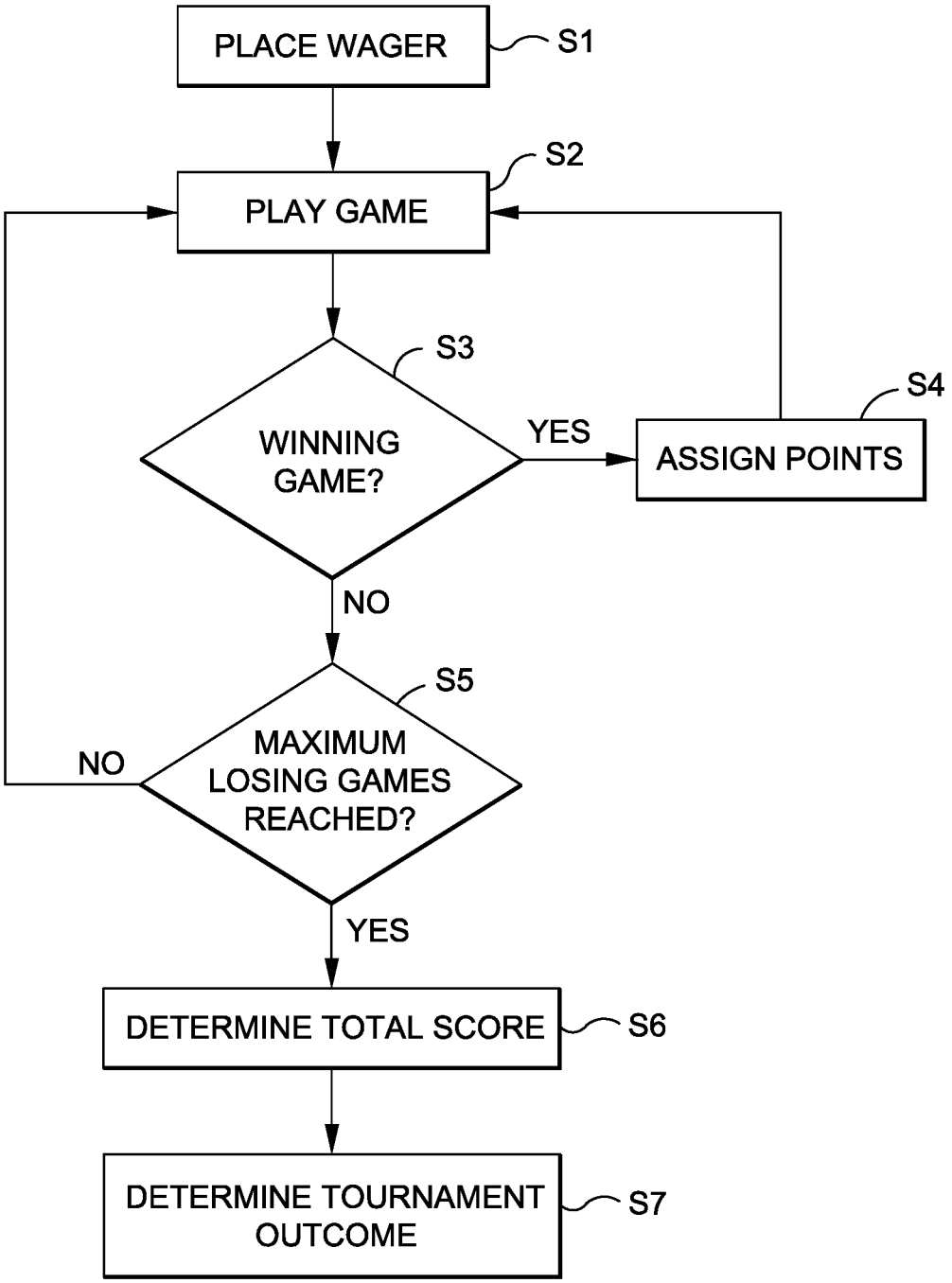
FIG. 3 is a flow chart which illustrates one embodiment of a method of the invention.

The flow diagram illustrated in FIG. 3 illustrates a method of tournament play relative to a single player. Preferably, two or more (and preferably a large number) of players participate in the tournament, wherein each player plays a number of games and then the outcome of the tournament is determined relative to the tournament scores for those players. In some embodiments, it is possible for a player to participate in the tournament multiple times, such as by paying separate entry fees and playing different sequences of games.

In one embodiment, the tournament is implemented relative to a system such as that described above where players play individual games at gaming devices of the system. The system may be configured or arranged in various manners to implement the tournament. For example, a system operator may program the tournament server to open a tournament at 1 pm on August 1 and close the tournament at 1 pm on August 10, whereby any player who signs up and begins play during that window of time can participate in the tournament (thus, the players do not have to play at the same time; in this example, a first player might sign up and start play of their games on August 2 and finish that same day while another player might not sign up and begin play until August 10 and might not finish play of their games until August 11). Players may pay the entry fee at a gaming machine linked to the tournament server. In one embodiment, each gaming machine presents the individual games to the player thereof, including determining the score and outcome of the game. The gaming machine may communicate with the tournament server, such as to verify that the tournament is still active before each game is presented and to report each game outcome, including the player's score (or the gaming machine might simply report the player's final score).

In this configuration, the tournament server may store game play data, such as the game outcomes, points awarded to each player, their total score and the like, in a database. In one embodiment, the tournament server may identify a player via player tracking information provided to the gaming machine/system (for example, the player may have a player tracking account which identifies the player and the player may use a player tracking card, account number or other identifying information at the gaming machine to identify themselves). Of course, other information or techniques may be used to link a player's tournament play to the tournament, such as via an assigned tournament number or the like.

Further, the system may be configured in other manners. For example, in one embodiment, the tournament server may generate individual game information which is transmitted to and displayed by the gaming machines. The tournament server may assign points for winning game outcomes, where those points are then tracked by the tournament server.

Once the tournament has ended (such as after all players have achieved the threshold number of losses and their scores have been determined), the tournament server may review the results to determine the winner(s) of the tournament and, for example, award awards. Of course, the awards might be awarded in various manners. In one embodiment, awards might be credited to a player's player tracking or casino account (or other financial type account), the player might pick up their prize, such as a cashier station or the like. In one embodiment, winners might be announced in various manners (via announcement boards, email, phone text message, live announcement or other ways).

In one embodiment, the winner or winners may receive awards of a set value. In other embodiments, winning players might be paid a jackpot which has a variable amount, such as based upon the number of players who entered the tournament. As one example, the one or more winners might be paid winnings in a pari-mutuel pool format, such as where the house applies a take-out or rake to the entire entry fee pool and then distributes 75% of the remaining pool to the player with the highest score (that award might be split if one or more players have the same high score) and then 25% to the runner-up. In another embodiment, an operator might provide fixed value awards, such as if one or more players achieve designated target point values (for example, any player achieving a 10,000 point total or greater might receive a $1000 award, while players who achieve 5000-10,000 points might receive a $250, award, etc.)

One aspect of the invention is a gaming tournament where each player is allowed to participate in the tournament by playing individual games having winning and losing outcomes, until such time as the player receives a certain threshold number of losing outcome. This contrasts with tournaments where a player can only play so long as they still have monies to wager, or can only play for a set number of games or for a set time duration or the like.

In one embodiment, points are assigned for winning outcomes. Of course, other information might be used to track or rate game outcomes. In one embodiment, the points may be won or awarded based upon particular criteria which makes the tournament more dynamic, such as described in more detail below.

While invention may be implemented relative to gaming machines associated with a tournament server, the tournament could be implemented in other manners. For example, the tournament could be implemented in an online environment, such as relative to player using a gaming device comprising a computing or communication devices and a web server. The tournament could also be implemented relative to gaming tables.

In one embodiment, the tournament is implemented as a wagering game where monetary winnings are awarded. However, as briefly noted above, the tournament could be implemented, as a promotional event where the player is not obligated to pay a fee to participate (although in some cases, a player might be required to make a purchase or meet other criteria in order to participate in the tournament). As one example, a casino might offer carded (e.g. players who have signed up for the casino's player loyalty program) players a single free entry into a tournament which offers monetary awards, prizes or the like.

Figure 4:
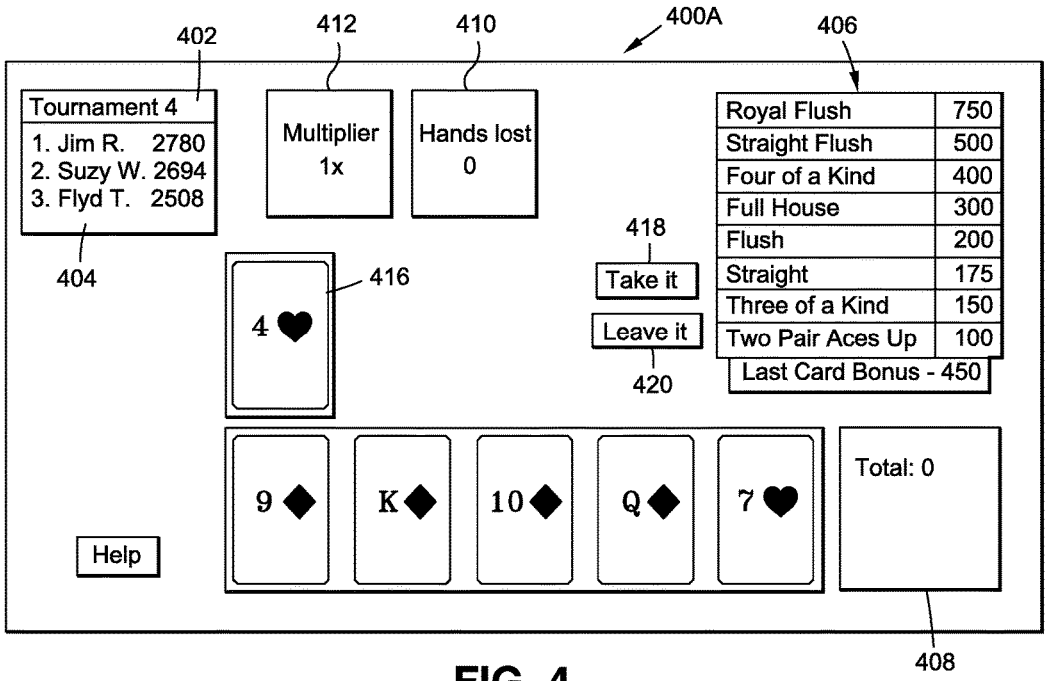
FIGS. 4-11 illustrate another example of game play in accordance with a method of the invention.

One example if the invention will be described with reference to FIGS. 4-11. These figures show graphical interfaces or displays which may, for example, be displayed by one or more displays of a gaming machine or device which the player is playing. FIG. 4 illustrates one such game display or interface 400A. In this example, the player has entered "Tournament 4", such as by placing a tournament entry fee if such was required.

In one embodiment, each game which the player plays as part of the tournament comprises a draw-poker type game where a player is dealt an initial hand of cards and is given the opportunity to take or leave one or more additional replacement cards in an attempt to improve their hand and achieve a gaming winning hand. In one embodiment, the player is given the opportunity to take or leave five (5) or six (6) additional cards, but the number of available replacement cards may vary.

In one embodiment, the object of the game is for the player to achieve one or more designated hands or combinations of cards. If the player does so successfully, the outcome of the game is winning. If the player is unsuccessful in achieving one of the designated hands or combinations of cards, the outcome of that game is losing. In accordance with the invention described above, if the outcome of the game is winning, the player is preferably assigned points, and if the player obtains a predetermined number of losing outcomes, then the player's participation in the tournament ends (e.g. the player's total score is then set and is used in determining the outcome of the tournament).

In the example illustrated in FIG. 4, the interface 400A display information regarding the tournament which the player has entered, such as the tournament name or number 402 and a current leaderboard 404 of the one or more players with the highest scores. The interface 400A also displays a list or paytable of winning game outcomes, such as winning card hands and their associated point values 406. The interface 400A may also display a variety of other information, such as the player's current tournament point total 408, a number of games or hands which the player has lost so far in the tournament 410, a multiplier value 412 and/or other information. In this example, the player is playing their first game of the tournament and so the player has 0 awarded points, 0 lost games or hands, and a 1× point multiplier.

In this example, the player has been dealt an initial five (5) card hand of cards 414 (although again, the number of cards and how the cards are dealt may vary, such as depending upon the particular game which is being presented). In this example, the cards are dealt by presenting or displaying graphical images of the cards or by dealing physical cards. The cards might be dealt from a single deck of standard playing cards (having card values of A, 2 3, 4, 5, 6, 7, 8, 9, 10, J, Q, K in each of the four suits Hearts, Spades, Clubs and Diamonds), or from two or more of such decks. In a graphical embodiment, a random number generator or the like might be used to randomly select the cards from the one or more virtual decks. In variations of the tournament where games are presented using physical cards, such cards may be dealt from one or more shuffled decks, such as from a card shoe. The cards dealt to each player are preferably dealt or displayed face up.

In one embodiment, a player is presented with one or more cards which the player may "take" or "leave". If the player takes a replacement card they player may replace one of the cards in their hand with that card. Alternatively, the player may leave the offered replacement card.

In this example, the player's initial hand 414 does not yet comprise a winning hand. Thus, the player will attempt to use the offered replacement cards to try and improve their hand into a winning hand. The first replacement card 416 offered to the player is the 4♥. In this example, the player has elected to "leave" (e.g. not take or accept) that card, such as by pressing a touch screen area over a displayed "Leave It" 420 icon (or by providing input to another input device, etc.).

Figure 5:
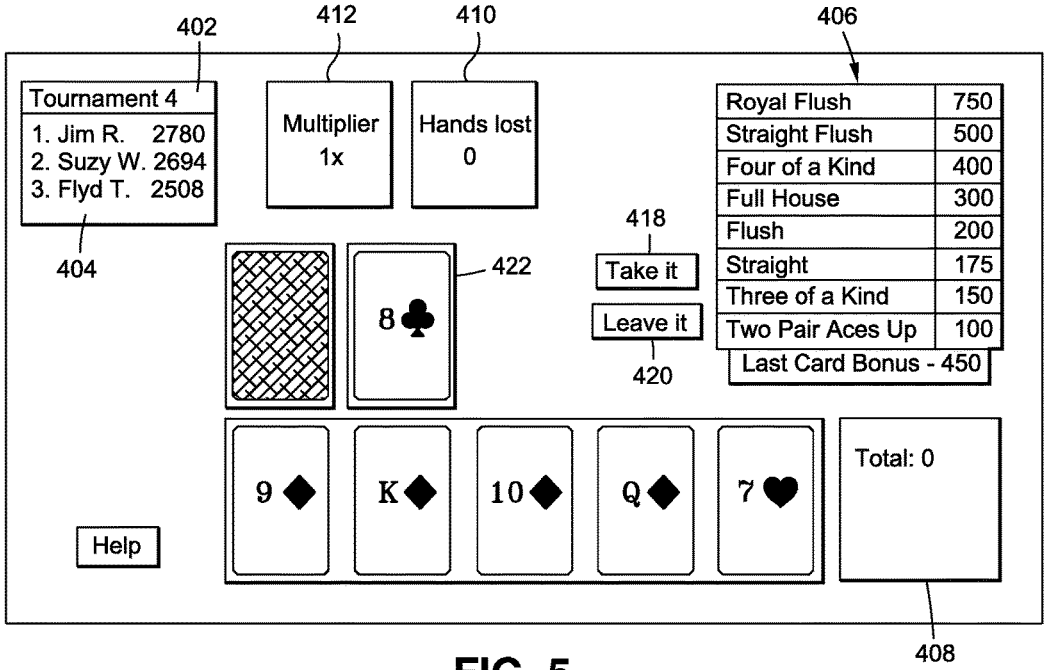

Thus, as illustrated in FIG. 5, the game continues with the player being offered a second displayed replacement card 422, the 8♣. Again, given that this card does not appear to improve the player's hand, the player has elected to leave that replacement card, such as by providing a "Leave It" input 420.

Figure 6:
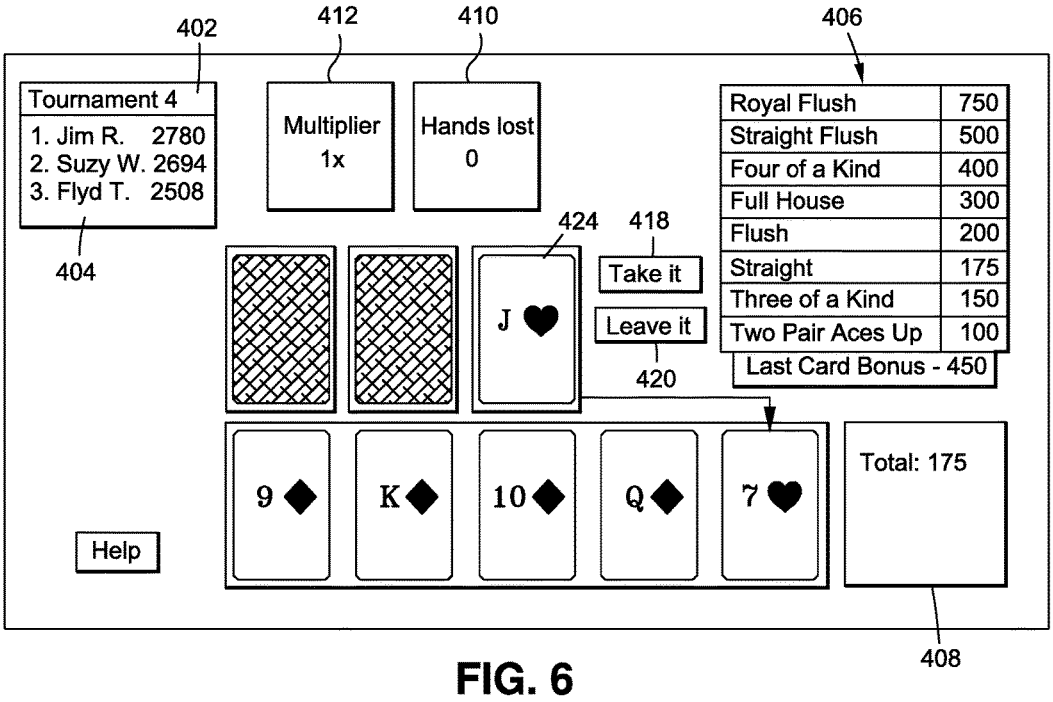

As illustrated in FIG. 6, the game then continues with the player being offered a third replacement card 424, the J♥. The player has elected to take that card, such as by selecting a "Take It" input 418. In one embodiment, the player is given the opportunity to select which card from their hand that they would like to replace. In this case, the player has elected to replace the 7♥ in their hand with the J♥ replacement card. This causes the player's hand to then form a Straight (in this case a 9-10-J-Q-K straight). As such, assuming that the player's final hand remained a straight, the player would be awarded 175 points.

Figure 7:
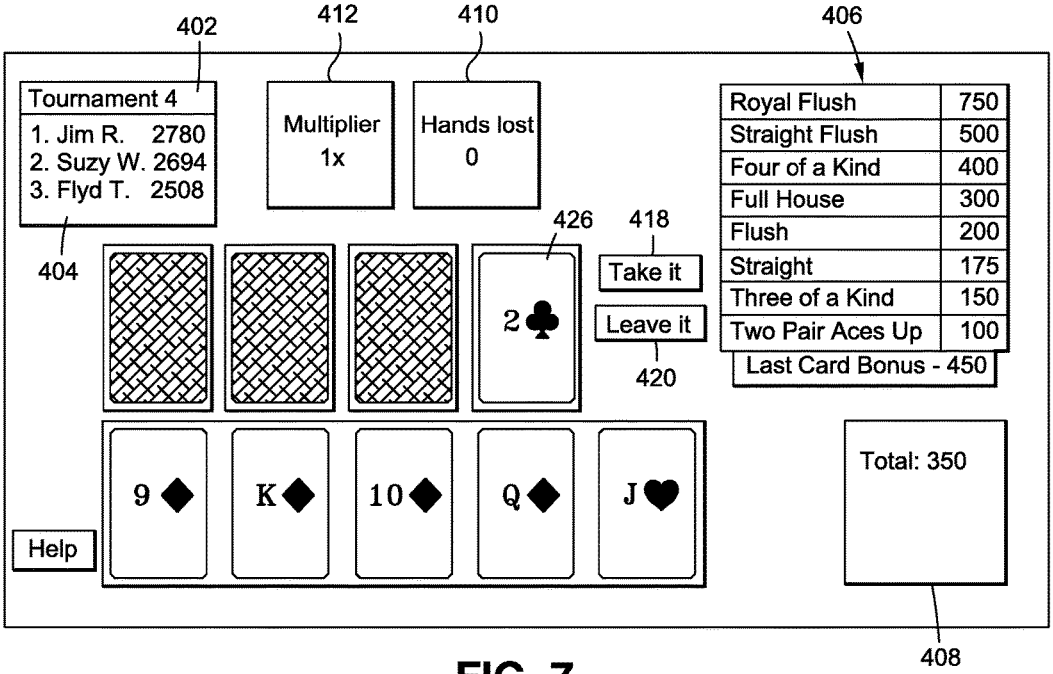

Next, as illustrated in FIG. 7, the game continues with the player being offered a fourth replacement card 426, the 2♣. Again, given that this card does not improve the player's hand, the player has elected to leave that replacement card, such as by providing the "Leave It" input 420. Because the player's hand still comprises a straight, the player is awarded (subject to the player having a final winning hand) another 175 points (for a total of 350 points).

Figure 8:
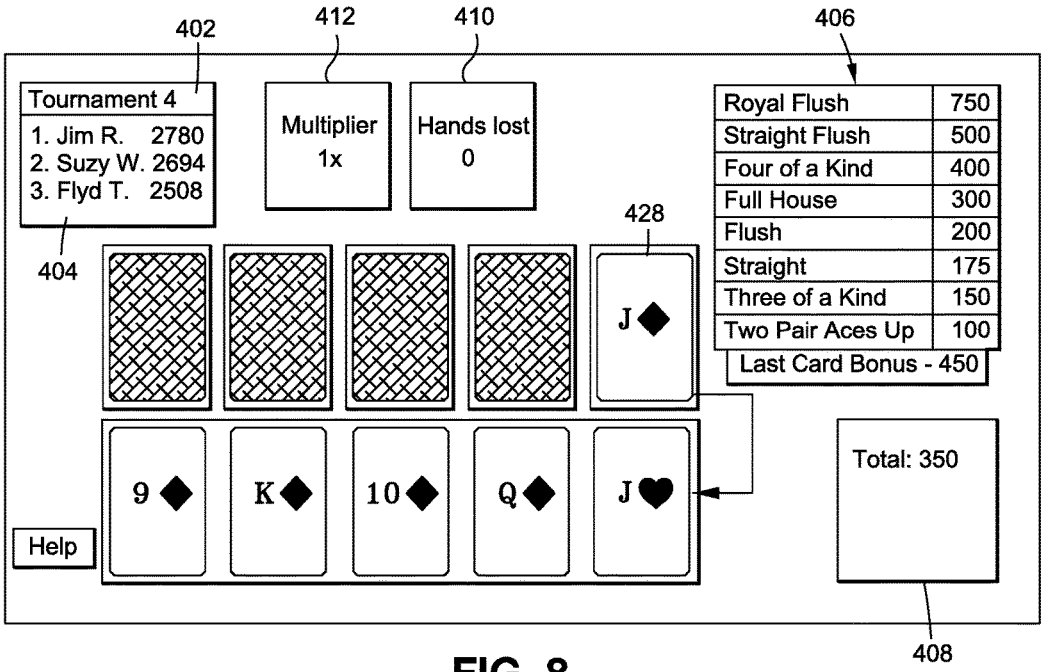
Figure 9:
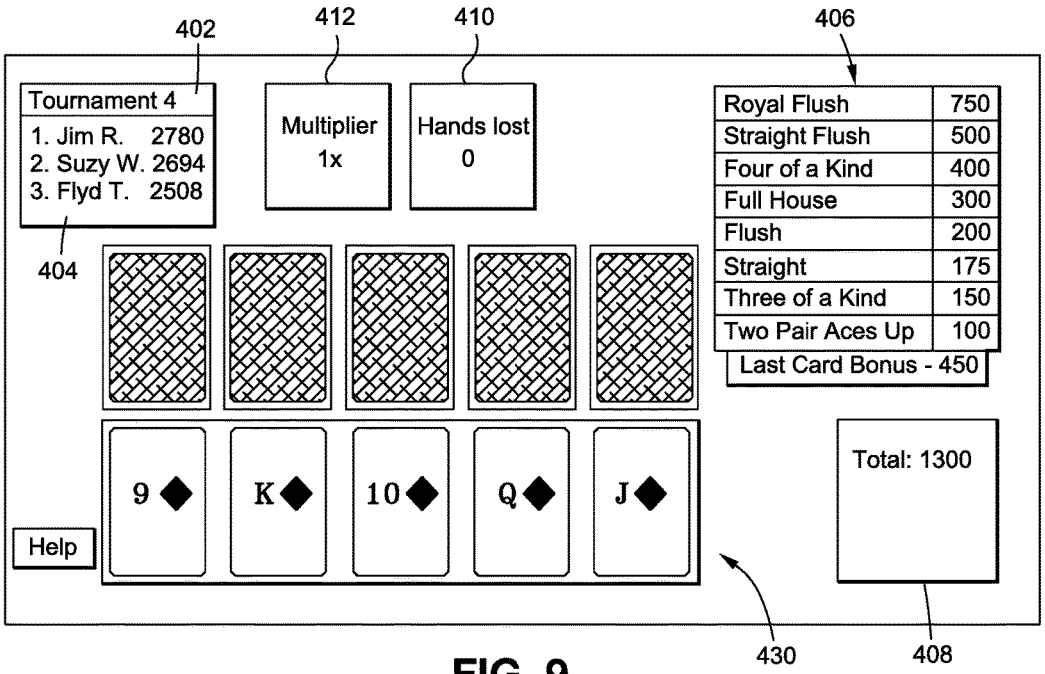

As illustrated in FIG. 8, the game continues with the player being offered a fifth and final replacement card 428, the J♦. In this case, the player has elected to take the replacement card and use it to replace the J♥. This results in a final player hand 430 as illustrated in FIG. 9—a straight flush. This hand entitles the player to another 950 points—500 points for receiving a straight flush and 450 points for achieving that hand on the last card (last card bonus). When these points are added to the player's earlier 350 points, the player achieves a final score for that game of 1300 points.

Figure 10:
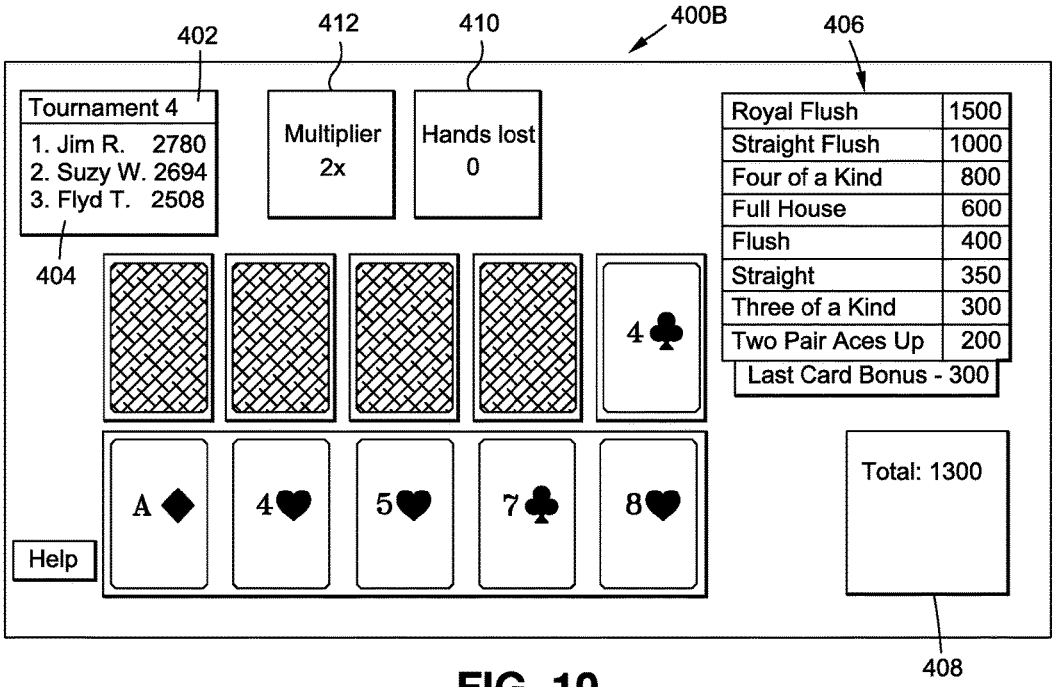

The game then ends. The player would then be presented with another game to play. FIG. 10 illustrates a graphical game display 400B of part of a next or second game. As illustrated, because the player won the previous game, the point awards for the winning hands are preferably doubled. This is indicated by a 2× multiplier value 412 and double point values in the paytable 406.

Figure 11:
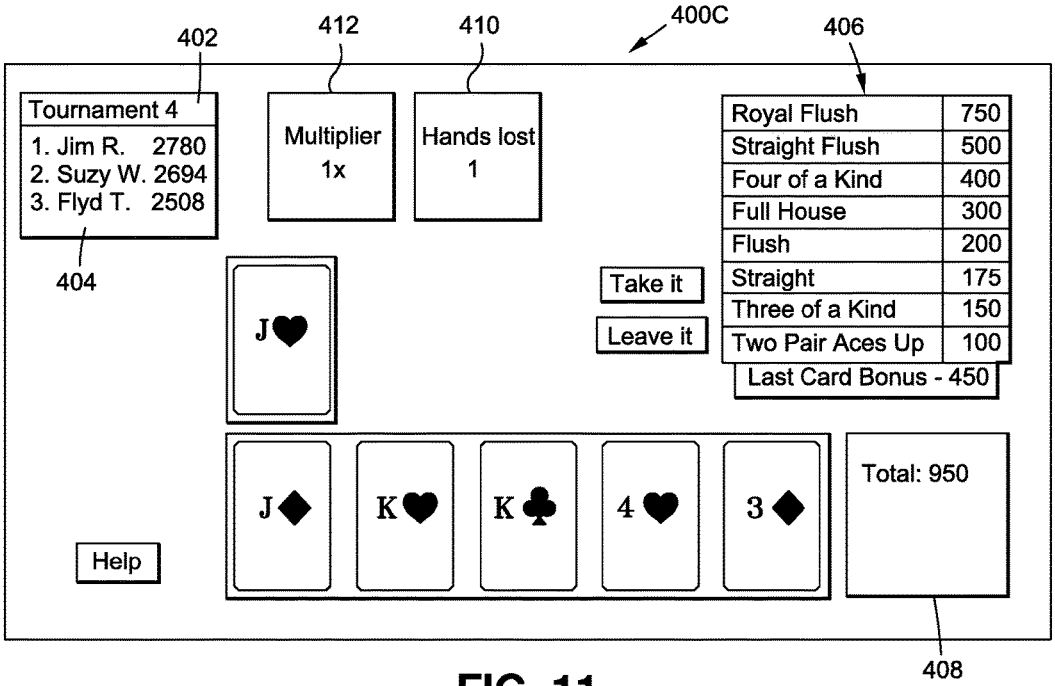

FIG. 10 illustrates the second game at a point where the player is being offered their fifth and final replacement card. As illustrated, even if the player took this last replacement card, their final hand would not comprise one of the winning hands. As such, this game or hand is a losing hand and the player is not awarded any points. Again, assuming that time remains in the tournament, the player would then be presented with another game to play, as illustrated in FIG. 11. As illustrated, because the player lost the last game or hand, the "hands lost" count 410 has increased to one (1). Further, the point multiplier value 412 has reset to 1× (and the points for winning hands have reset back to their base values in the pay table 406). The player then begins playing this game, such as with the first replacement card being displayed (the J♥). The play of this game would then continue.

In this example, the play of games would continue until the player received or reached the threshold number of losing hands, such as five (5). At that point, the player's total number of awarded points would comprise the player's point total or score for the tournament. If the player's point total was one of the top point totals, their score may appear in the leader board 404, such as to be visible to other players. When the tournament ends, the player's score would be compared to the point totals or scores of other players in the tournament, with the player's having the highest score(s) being declared the winners and preferably being awarded winnings. This example tournament thus incorporates the inventive feature that players play a number of games until they achieve a predetermined number of losing outcomes.

This tournament and the games comprising the tournament, however, have additional features. The individual games offer the player multiple opportunities to achieve a winning game outcome or hand, such as by offering a sequence of replacement cards (preferably five (5) or more).

In this embodiment of the invention, a dynamic point awards structure is provided which enables a player to achieve high point totals. First, a player's point total for the game is increased if the player receives a winning game outcome or hand early in the game and then still finishes the game with a winning game outcome or hand, in that points are assigned at each replacement card round. Thus, for example, if a player received a Flush hand after the first replacement card and then did not change their hand, they would be awarded points for a Flush hand for each of the four rounds of replacement cards thereafter—thus quadrupling their point total for the game as compared to a situation where the Flush hand is only achieved with the last replacement card or in a situation where points are only awarded based upon the rank of the final hand. This configuration thus awards a player for forming a winning hand as early in the game as possible (even though this might cause the player to not be able to form as high of a rank of a winning hand in the end). Of course, if the player were to make a card replacement which caused the player's hand to no longer form a winning hand at the end of the game, then any previously assigned points for that game would be lost.

Also, in this embodiment, a multiplier value or points increase is applied when the player wins a game. In this example, a multiplier value for points increases each time the player achieves a winning hand. The multiplier value could increase by one (1) for each consecutive winning hand, but could increase by other values. If a player obtains a losing hand, the multiplier value then resets. This configuration awards the player for achieving sequences of winning hands by awarding the player higher points for later winning hands.

Additional aspects of the present invention, including advantageous thereof, will now be described.

While examples of the invention have been described relative to the play of video-poker type games at a gaming device, as noted herein the tournament may be played or presented via other devices and systems, and relative to other games. As noted, the tournament might be implemented relative to the play of games at a gaming table. Such a gaming table might comprise a pure electronic table which has a table surface and then features similar to the electronic gaming machine described above, such as a plurality of player stations each comprising a video display, player input devices, a monetary value accepting device and the like. In yet another embodiment, the invention might be implemented relative to a game table at which physical playing cards are dealt by a dealer. In this embodiment, cards which are dealt may be scanned or read, such as via a card scanner. A processor might then use the scanned card information to determine winning and losing hands and associated game scores and the like.

Further as noted herein, the tournament could comprise the play of games other that poker. For example, a player might play blackjack games (including against a dealer) until the player achieves a predetermined number or threshold of losing game outcomes. The principles of the invention might also be applied to slot-type games where game symbols are randomly selected and displayed, such as in a rotating reel format. However, the invention is preferably implemented relative to the play of skill-based games or games having a skill component, e.g. wherein an action or decision by the player has an impact upon the outcome of the game, and relative to games that offer a relatively high spread or outcomes. Such a configuration increases the excitement to the player as compared to game where the outcomes are randomly determined and the player thus has no involvement in the game outcome. Also, such a configuration can result in a larger "spread" of outcomes (and thus scores) between players. For example, in a situation where all game outcomes are randomly determined, each player will have essentially the same probability of achieving winning and losing outcomes. However, with games having skill components, players having lower skill will be anticipated to have much lower probabilities of winning (and thus lower scores) than players with a high skill level. Further, games like poker where a plurality of different hands or outcomes may be designated as winning and be assigned a wide range of points values allows for a wide distribution of player point totals, making the game very dynamic (for example, if the range of outcomes caused all players to have total scores only between 1-50, relative to a large number of players, a lot of players would likely have the same score and might often result in multiple winners, whereas when the tournament is applied to games having the features above, there is preferably a very wide range of scores with only a few players having the highest scores even when large numbers of players are in the tournament).

In one or more embodiments of the invention, these same features (tournament only ends as to a player with a threshold number of losses and where the underlying skill-based games offer a large point spread) solves the problem(s) of existing tournaments (such as slot tournaments where the outcomes of the slot games are purely randomly determined and where the tournament ends after a set period of time or set number of spins) where players getting too far behind to catch up (e.g. the player knows early on in the tournament that they will not win). In particular, the format of the invention allows players to continue in the tournament until they have a predetermined amount of failures or losing outcomes. This allows players to get on a streak that can overcome a bad start. In one embodiment, players receive multiplied awards based on the amount of successive outcomes won. Additionally, in the preferred embodiment where the game is skill based, the better the strategy a player uses to improve their hand, the greater chance the player will be successful (e.g. the dynamic point structure introduces the possibility of a player achieving high point totals for games played even after they started with a number of losses or even when some winning games had low point totals), thus giving the player a chance to still have a sufficiently high point total to win the tournament).

It will also be appreciated that aspects of the invention may be utilized in different orders and apart from one another. For example, the tournament configuration where players play games until they achieve a designated number of losses may be implemented without the point award system described herein.

It will also be appreciated that other point award or scoring systems might be utilized. For example, in one embodiment, points might be awarded to a player for both losing and winning outcomes, depending upon those outcomes. As one example, a player might be awarded a number of base points for a losing game outcome, where the number of points increases for each consecutive game loss. Further, instead of multipliers, other paytables of points or the like might be used to provide increased point awards. Also, while in one embodiment of the invention a poker game is provided where a player must achieve a poker hand rank of at least Two Pair of Aces to achieve a winning hand, other paytables of winning hands might be utilized.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A tournament gaming system comprising:

a plurality of gaming machines, each gaming machine comprising a monetary funds accepting mechanism for accepting monetary funds in creating a player credit balance, at least one display device, at least one player input device, a memory device, a controller, and machine-readable code stored in said memory device executable by said controller to, in response to a tournament fee placed by said player from said player credit balance, present games associated with a gaming tournament comprising:

(a) causing said at least one display device to display game information regarding a game;

(b) determining an outcome of said game as winning or losing;

(c) awarding points to said player for a winning outcome of said game; and (d) repeating steps (a)-(c) until such time as a player has received a designated number of losing game outcomes;

and at least one tournament game server, said at least one game server comprising:

a processor configured to execute machine readable code;

at least one communication interface which permits said game server to transmit information to said plurality of gaming machines and to receive information from said plurality of gaming machines; and machine readable code executable by said processor configured to cause said tournament server to determine an outcome of said gaming tournament based upon a total score of each player comprising a sum of points awarded to each player for winning game outcomes and award at least one award to at least one winner of said gaming tournament.

2. The tournament gaming system in accordance with claim 1 wherein the one or more players with the highest total score is determined to be the winner of said gaming tournament.

3. The tournament gaming system in accordance with claim 1 wherein said designated number of losing outcomes comprises 5 or more.

4. The tournament gaming system in accordance with claim 1 wherein said game comprises a poker game and said game information comprises images of one or more cards.

5. The tournament gaming system in accordance with claim 1 wherein said game comprises a poker game and one or more hands of cards are designated as winning hands and remaining hands of cards comprise losing hands.

6. The tournament gaming system in accordance with claim 5 wherein each winning hand is assigned an associated number of points.

7. The tournament gaming system in accordance with claim 1 wherein said game comprises a poker game and said game information comprises an initial hand and a plurality of potential replacement cards.

8. The tournament gaming system in accordance with claim 7 comprising machine-readable code executable by said controller which allows said player to provide input to replace a card in the player's initial hand with one of said replacement cards.

9. The tournament gaming system in accordance with claim 7 comprising at least 5 potential replacement cards which are displayed in sequence.

10. The tournament gaming system in accordance with claim 7 wherein a number of awarded points increases when a winning outcome is achieved with fewer replacement cards.

11. The tournament gaming system in accordance with claim 1 wherein each game comprises a skill-based game.

12. A method of presenting a gaming tournament to a plurality of players of gaming machines associated with at least one tournament server, comprising the steps of:

creating a player funds balance based at least in part upon funds provided by a player to a monetary value acceptance device of at least one of said gaming machines;

receiving a tournament fee placed by said player from said player credit balance;

presenting games associated with a gaming tournament at said gaming machine comprising:

(a) causing at least one display device to display game information regarding a game;

(b) determining an outcome of said game as winning or losing;

(c) awarding points to said player for a winning outcome of said game; and (d) repeating steps (a)-(c) until such time as a player has received a designated number of losing game outcomes;

and determining an outcome of said gaming tournament at said at least one tournament server based upon a total score of each player comprising a sum of points awarded to each player for winning game outcomes.

13. The method in accordance with claim 12 wherein said designated number of losing game outcomes comprises at least five (5).

14. The method in accordance with claim 12 further including the step of said gaming machine reporting said points awarded to said player to said at least one tournament server.

15. The method in accordance with claim 12 wherein each game comprises a skill-based game.

16. The method in accordance with claim 12 wherein each game comprises a video poker game and winning outcomes of said game comprise predesigned poker hands.

17. The tournament gaming system in accordance with claim 1 wherein a number of points awarded for a winning outcome of said game is increased when said winning outcome is a successive winning outcome.

18. The tournament gaming system in accordance with claim 17 wherein said number of points is increased by a multiplier value which increases with each successive winning outcome.

19. The method in accordance with claim 12 comprising awarding a higher number of points for a winning outcome of said game when said winning outcome is a successive winning outcome.

* * * * *